US009640380B1

(12) United States Patent
Brockett et al.

(10) Patent No.: US 9,640,380 B1
(45) Date of Patent: May 2, 2017

(54) ELECTRODELESS HIGH INTENSITY DISCHARGE LAMP WITH WAVE-LAUNCHER

(71) Applicant: SPL Industries USA, Inc., Encino, CA (US)

(72) Inventors: Timothy J. Brockett, Malibu, CA (US); Gregg A. Hollingsworth, Tempe, AZ (US); Mehran Matloubian, Encino, CA (US)

(73) Assignee: SPL INDUSTRIES USA, INC., Encino, CA (US)

( * ) Notice: Subject to any disclaimer, the term of this patent is extended or adjusted under 35 U.S.C. 154(b) by 0 days.

(21) Appl. No.: 15/270,238

(22) Filed: Sep. 20, 2016

(51) Int. Cl.

| | |
|---|---|
| ***H05B 37/02*** | (2006.01) |
| ***H01J 65/04*** | (2006.01) |
| ***H01J 61/30*** | (2006.01) |
| ***H05B 41/24*** | (2006.01) |

(52) U.S. Cl.
CPC ..... *H01J 65/042* (2013.01); *H01J 61/302* (2013.01); *H05B 41/24* (2013.01)

(58) Field of Classification Search
CPC ..... H05B 41/3925; H05B 41/391; H05B 41/2828; H05B 41/24
USPC ..... 315/224, 291, 248, 39, 209 R
See application file for complete search history.

(56) References Cited

U.S. PATENT DOCUMENTS

| | | | | |
|---|---|---|---|---|
| 5,598,069 | A * | 1/1997 | van Os | H01J 61/20 313/490 |
| 6,922,021 | B2 * | 7/2005 | Espiau | H01J 61/025 315/111.41 |
| 7,830,092 | B2 * | 11/2010 | Espiau | H01J 65/042 315/248 |
| 2003/0015479 | A1 * | 1/2003 | Kuennen | A61L 2/10 315/224 |
| 2004/0239263 | A1 * | 12/2004 | Vakil | H05B 41/2828 315/291 |
| 2007/0085487 | A1 * | 4/2007 | Kuennen | A61L 2/10 315/209 R |
| 2009/0262530 | A1 * | 10/2009 | Tickner | F21K 9/00 362/235 |
| 2014/0001977 | A1 * | 1/2014 | Zacharchuk | H04L 12/2816 315/291 |

* cited by examiner

*Primary Examiner* — Douglas W Owens
*Assistant Examiner* — Syed M Kaiser
(74) *Attorney, Agent, or Firm* — Richard T. Ogawa; Ogawa P.C.

(57) ABSTRACT

Electrodeless high intensity discharge (HID) lamps have the promise of higher reliability and higher efficiency than traditional electroded high intensity discharge lamps. However, most electrodeless HIDs operate in the frequency range of around 400 MHz or higher resulting in expensive, inefficient RF drivers that reduce the overall efficacy of the lamp. Operating the lamp at lower frequencies results in substantial increase in the physical dimensions of the resonators used in traditional electrodeless HIDs. In this invention a novel wave-launcher technology is used allow the lamp housing's operating frequency to be independent of the physical dimensions of the lamp housing. This provides an avenue to increase the conversion efficiency of the RF driver and the efficacy of the lamp system.

20 Claims, 12 Drawing Sheets

ELECTRODELESS HIGH INTENSITY DISCHARGE LAMP WITH WAVE-LAUNCHER

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention is directed to devices and methods for generating light with electrodeless high intensity discharge (HID) lamps. More particularly, the present invention provides high intensity discharge lamps driven by a radio-frequency source without the use of electrodes inside a gas-filled vessel (bulb) and related methods. Merely by way of example, such electrodeless HID lamps can be applied to applications such as parking lots, street lights, warehouses, stadiums, security, ports and harbors, large and small buildings, vehicle headlamps, billboard lighting, building facade lighting, airports, bridges, agriculture and horticulture lighting, architectural lighting, stage and entertainment lighting, medical illumination, microscopes, projectors and displays, ultraviolet (UV) water treatment, UV curing, any combination of these, and the like.

High intensity discharge lamps provide extremely bright and broad spectrum light source. Typical conventional electroded HID manufactured today contains a bulb with a mixture of gas and metal halides that are excited to form a plasma using a high current passed through closely-spaced electrodes. This arrangement, however, suffers from deterioration of the electrodes over time, and therefore a bulb with continual degradation of performance and limited lifetime.

Electrodeless high intensity discharge lamps driven by radio frequency (RF) sources have been proposed in the prior art. Some configurations include a metal halide fill encased either in a bulb or a sealed recess within a dielectric body forming a waveguide, with RF energy being provided by an external source such as a magnetron or solid-state RF driver and introduced into the waveguide and heating the plasma resistively. Another example is provided by U.S. Pat. No. 6,737,809 B2, which shows a different arrangement. This patent shows an electrodeless bulb and a dielectric cavity forming a part of a resonant RF circuit with an RF driver (which produces and amplifies electromagnetic energy at radio frequencies) to provide excitation. Several limitations, however, exist with this approach. The dielectric cavity is spatially positioned around a periphery of the electrodeless bulb in an integrated configuration, which physically blocks a substantial portion of the light emitted from the bulb. In addition, the integrated ceramic and quartz bulb configuration is difficult to manufacture and limits the operation and reliability of the plasma-enclosing bulb. Furthermore, the dielectric material used in this approach is often costly because of the difficulty in manufacturing and the high purity that is required to achieve competitive performance versus other lighting technologies for most applications.

In another approach disclosed in U.S. Pat. Nos. 8,283,866 and 8,294,368, an air-cavity resonator with grounded coupling elements is used to provide advantages over previous dielectric waveguide/resonator approaches. The air cavity resonator eliminates the need to use costly dielectric material and the bulb is not surrounded by a dielectric material resulting in more efficient operation of the lamp. However, this approach has its own limitations. These lamps are typically operated at frequency of around 435 MHz which limits the conversion efficiency (direct current (DC) to RF conversion efficiency of ~80%) of the solid-state RF driver. If one also combines the efficiency of the alternating current (AC) to DC power supply (which must be used when the lamp is connected to standard electrical sources provided by electrical utilities) the overall efficiency of the lamp's source (AC to RF conversion efficiency of <74%) can drop to levels less competitive against other alternative lighting technologies such as light-emitting diodes (LEDs), HIDs, and fluorescent lamps.

To improve the overall system efficiency of the light source to levels that are more competitive against alternative lighting technologies, the efficiency of the RF driver can be increased by operating at a much lower frequency than 400 MHz (for example, 100 MHz). By using an RF driver at a lower frequency, such as 100 MHz, it is possible to achieve RF driver conversion efficiency (DC-to-RF) exceeding 90% and overall conversion efficiency (AC-to-RF) of around 83% to 88%. This is a significant improvement over current approaches and can improve the overall system efficiency of the light source to match or exceed the efficiency of other alternative lighting technologies such as traditional HIDs and LEDs. In addition, increasing the efficiency of the RF driver from 80% to 90% results in significant reduction of the dissipated power by the RF driver providing important benefits such as reducing the size and cost of the required heat sink and improving reliability. Operation at lower frequencies, however, is complicated by the fact that prior embodiments of the RF waveguide/resonator and air-cavity resonators are limited and can only be operated at these lower frequencies with techniques that force the lamp to be prohibitively large in size, cost, and complexity, and can result in significantly lower light output and efficacy.

From above, it is seen that techniques for improved electrodeless high intensity discharge lighting are highly desired.

BRIEF SUMMARY OF THE INVENTION

As mentioned above, previous embodiments of electrodeless HID lamps, such as described in (U.S. Pat. Nos. 3,787,705A; 6,922,021; and 7,830,092), rely on resonate components, dielectric resonator/waveguides, and/or cavities to determine the operating frequency of the lamp system. These structures are wavelength dependent, limiting operating the lamps above frequency of 400 MHz or higher to satisfy mechanical size and performance specifications and to reduce complexity and cost. Consequently, RF driver efficiency is reduced at higher frequencies, lowering the overall system efficacy of the lamp. In addition, RF component costs become higher and provide less performance (efficiency and power) at higher frequencies. Both are detrimental to the performance and cost of the overall lamp system in comparison to competing lighting technologies. Clearly, improvement in performance of the overall lamp system is dependent on lowering the operating frequency of the lamp to take advantage of both the lower costs and better efficiencies that can be achieved there. To allow for this, it is imperative for the lamp housing's size, complexity, and performance to be independent of the operating frequency.

In this invention, a novel wave-launcher module is introduced. When used in conjunction with the RF driver and lamp housing, it allows the lamp's operating frequency to be mostly independent from the dimensions of the lamp housing. This allows one to choose the operating frequency of the lamp system to a frequency where high efficiencies and lower costs can be achieved for the RF driver, improving the overall performance and reducing the costs and complexity of the lamp system.

The wave-launcher module can comprise of, but is not limited by, an electrical circuit or structural components that provide inductive and capacitive characteristics. The module should be designed to allow the RF energy from the RF driver to be transposed into the lamp housing, and in particular, launch the electromagnetic wave/fields to couple into the vessel to cause a discharge of electromagnetic waves in the form of infrared, visible, and UV light. Moreover, the design of the wave-launcher would be dependent on the overall structure of the vessel and its overall chemistry of the contents under power, the output impedance of the RF driver, and the configuration between the vessel and the lamp housing. Since the dimensions of the elements of the wave-launcher are relatively small compared to the lamp housing, it is possible to design for any desired operating frequency without requiring significant changes in lamp housing dimensions, effectively making the lamp's size independent from the operating frequency of the lamp system. The present invention achieves these benefits and others in the context of known process technology. However, a further understanding of the nature and advantages of the present invention may be realized by reference to the attached drawings.

BRIEF DESCRIPTION OF THE DRAWINGS

A more complete understanding of the present invention and its advantages will be gained from a consideration of the following description of preferred embodiments, read in conjunction with the accompanying drawings provided herein. In the figures and description, numerals indicate various features of the invention, and like numerals referring to like features throughout both the drawings and the description.

DETAILED DESCRIPTION OF THE INVENTION

Figure 1:
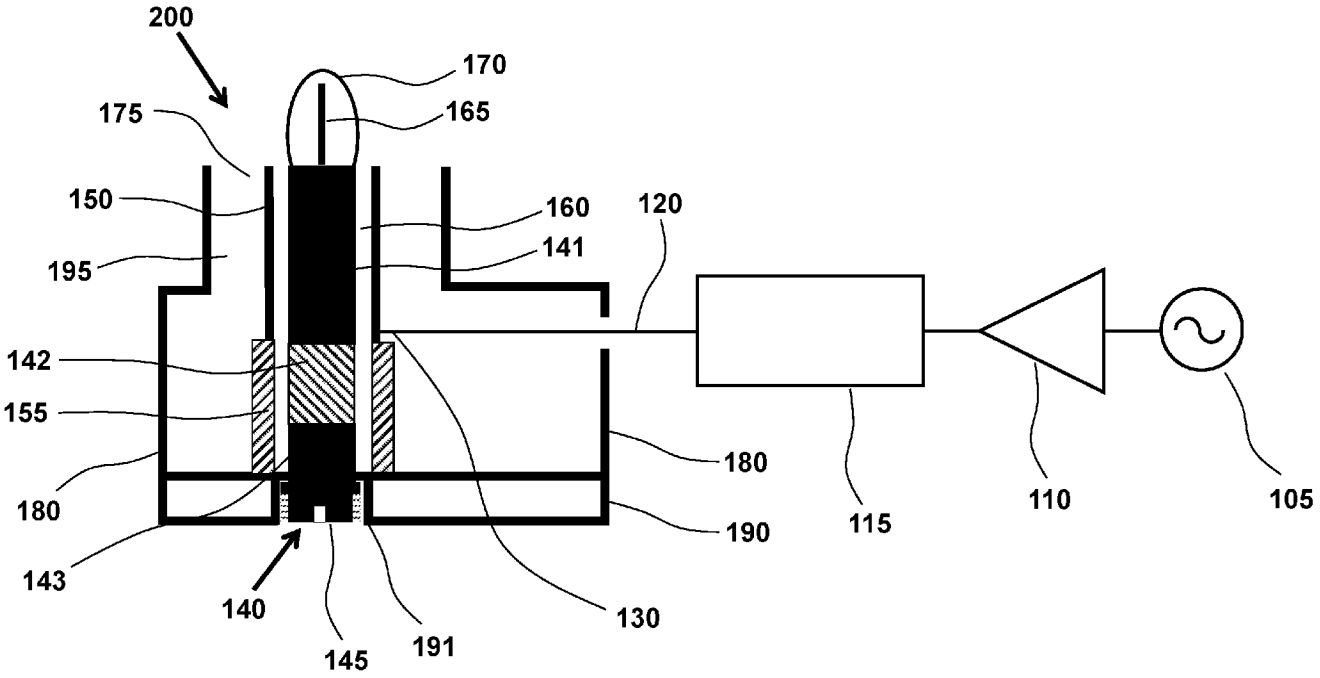
FIG. 1 is a drawing of one embodiment of this invention showing the electrodeless bulb assembly with, wave-launcher module, lamp housing, RF amplifier, and the RF source.

The present invention is directed to devices and methods for generating light with electrodeless HID lamps. More particularly, the present invention provides high intensity discharge lamps driven by an RF source without the use of electrodes inside a bulb and related methods. Merely by way of example, such electrodeless HID lamps can be applied to applications such as parking lots, street lights, warehouses, stadiums, security, ports and harbors, large and small buildings, vehicle headlamps, billboard lighting, building facade lighting, airports, bridges, agriculture and horticulture lighting, architectural lighting, stage and entertainment lighting, medical illumination, microscopes, projectors and displays, UV water treatment, UV curing, any combination of these, and the like.

The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object. Additionally, the terms "first" and "second" or other like descriptors do not necessarily imply an order, but should be interpreted using ordinary meaning.

As mentioned above, previous embodiments of electrodeless high intensity discharge lamps use a resonator/waveguide to couple the RF energy to a bulb or bulb-like vessel. Using these techniques, size and performance requirements force the frequency of operation of the resonator/waveguide to be 400 MHz or higher, and in consequence, limits the conversion efficiency of the RF driver and ultimately the efficacy of the lamp. In this invention, an innovative wave-launcher is disclosed that allows the dimensional size and the performance of the electrodeless HID lamp to be independent of the operating frequency, providing the ability to maximize the efficiency of the RF driver and increase the overall efficacy of the lamp.

In a specific embodiment, the novel electrodeless high intensity discharge lamp consists of a lamp housing. The lamp housing at least partially comprises of a conductive material or coating, such as aluminum, and can have any shape (circular, square, rectangular, cube, symmetrical, asymmetrical, etc.) with at least one aperture. An internal conductive member, comprised of electrically conductive or electrically conductively-coated material, must be positioned intimately within the aperture. A gap between the lamp housing and the internal conductive member must be maintained that electrically isolates the lamp housing and internal conductive member. In addition, a vessel assembly is coupled or situated near the internal conductive member. The aperture, internal conductive member, and the gap are customarily designed to arrange the electromagnetic wave/fields in a manner that effectively transfers energy into the vessel assembly. The vessel assembly comprises of a structure with two ends, with one end being a bulb-like vessel and the other end a structure to allow attachment such as a screw thread, bayonet connection, or similar mechanical attachment. In between, the assembly comprises of a combination of electrically conductive sections made from a metal or conductive material and/or non-electrically conductive sections that are still thermally conductive such as dielectric material or ceramic. The vessel is made from quartz or from a transparent or semi-transparent ceramic material. Within the vessel, there is ordinarily an inert gas such as argon or xenon and a combination of one or more metals and metal halides such as mercury, sodium, dysprosium, sulfur, indium bromide, scandium bromide, thallium iodide, holmium bromide, cesium iodide, or other similar materials. The vessel is attached to the rest of the assembly by using a high temperature epoxy or slurry such that the majority of the vessel is still exposed. The vessel assembly has one end attached onto a section of the lamp housing, or the output of the wave-launcher, depending on the configuration of the vessel assembly and internal conductive member. The vessel assembly can be replaceable. A separate RF driver/source comprising of an RF oscillator, a high power RF amplifier, and supporting electronics provides the RF energy to the wave-launcher module through an RF cable. The wave-launcher module transfers the RF energy from the RF source through the lamp housing and launches the electromagnetic waves/fields onto the internal conductive member and into the gap that it forms with the lamp housing. The high electromagnetic field produced in the gap region couple into the vessel and ionizes the gas, then melts and vaporizes the materials inside the vessel causing an intense emission of infrared, visible, and UV electromagnetic radiation.

The operating frequency of the lamp is primarily determined by both the physical properties of the plasma under power, the configuration of the lamp housing, internal conductive member, the gap region in between, and the components comprised within the wave-launcher module. The operating frequency is not dependent on the overall dimensions of the lamp housing.

Typical dimensions of the lamp module would be around 75 mm-100 mm in diameter (or width) and about 50 mm to 100 mm in height. In comparison, using techniques in prior art, typical dimensions would be 300 mm to 1500 mm in diameter (or width) and about 150 mm to 200 mm in height. Commonly, the wave-launcher and lamp housing would be designed so that the wave-launcher could fit within the lamp housing, if so desired.

In another embodiment of this invention the internal conductive member is integrated directly with the vessel assembly. The wave-launcher is directly connected to a conductive portion of the vessel assembly that is electrically isolated from the lamp housing. As in the previous embodiment, the conductive portion is configured to create a gap between itself and the lamp housing. The wave-launcher is then coupled onto the conductive portion to launch the RF energy into the gap region. Similar to the previous embodiment, the high electric field ionizes the gas in the bulb and produces light emission.

In another embodiment of this invention, the vessel assembly consists of two conductive rods separated by a dielectric or non-conductive rod that is inserted into the two aluminum rods and connects all the pieces together. The non-conductive rod can be made from a dielectric or ceramic material such as alumina. At one end of one of the conductive rods the vessel is inserted partially into a hole and attached via high temperature epoxy or slurry. A substantial part of the vessel is exposed. The other end of the vessel assembly has a threaded screw or bolt which can be used to attach the vessel assembly to the lamp housing. The non-conductive rod of the bulb assembly electrically isolates from the body of the lamp module while still being able to conduct heat away from the vessel and into the lamp housing. The ceramic rod does not transmit any electromagnetic energy and can be made from lossy or low-quality ceramic materials. Its dimensions also have no impact on operating frequency of the lamp module. This embodiment also has the internal conductive member which creates the gap between the member and the lamp housing. The wave-launcher module connects the RF source to the internal conductive member and transfers the energy between them.

In yet another embodiment of this invention, the vessel assembly consists of a vessel attached via a high temperature epoxy or slurry to a non-conductive rod. At the other end of the vessel assembly, a threaded screw head or bolt is used to attach the vessel assembly into the lamp module. The vessel is electrically isolated from the body of the lamp module. The ceramic rod acts as a support structure and allows for transfer of heat but does not transmit any electromagnetic energy and can be made from lossy or low quality ceramic material. Its dimensions have no impact on operating frequency of the lamp module. This embodiment also has the internal conductive member which protrudes through the opening of the lamp module and concentrates the high electromagnetic waves/field in the vicinity of the gap between the internal conductive member and the lamp housing. The wave-launcher connects the RF source to the internal conductive member and also transfers the electromagnetic energy between them.

In another embodiment of this invention, a thin dielectric layer is used between the vessel assembly and the internal conductive member. The thin dielectric layer can be the surface anodization or oxidation of the conductive sections of the vessel assembly and the internal conductive member or a separate dielectric piece that is placed between the vessel assembly and the internal conductive member.

In yet another embodiment of this invention, the wave-launcher module consists of a capacitor between the center conductor and the ground (shunt capacitor) and a series inductor. Alternately, instead of one capacitor and one inductor, the wave-launcher module can consist of a combination of capacitors and inductors with a combination of components in parallel and some components in series. The values of these capacitors and inductors determine the desired operating frequency of the electrodeless HID lamp and the effectiveness by which the electromagnetic waves/fields are launched across the gap region between the internal conductive member and lamp housing.

In yet another embodiment of this invention, the wave-launcher module consists of a variable capacitor and a variable inductor. The wave-launcher module can also consist of a combination of fixed and variable capacitors and inductors. The use of variable capacitors and inductors allows the wave-launcher module to be tuned during production to set the exact frequency of operation of the electrodeless HID and optimize/maximize the efficiency of the wave-launcher.

In yet another embodiment of this invention, the wave-launcher module consists of inductors and capacitors that are integrated into the body of the lamp housing. The input of the wave-launcher is connected to the output of the RF source and the output of the wave-launcher is connected to the internal conductive member that is incorporated or surrounds the vessel assembly.

In yet another embodiment of this invention the wave-launcher module consisting of a circuit board with a printed or etched spiral inductor and surface mount capacitors in parallel and/or series, and is integrated as part of the lamp housing. The input of the wave-launcher is connected to the output of the RF source and the output of the wave-launcher is connected to the conductive sleeve.

In yet another embodiment of this invention the wave-launcher module consisting of one or more solid metallic or conductively coated spiral or helical coil inductors and one or more parallel plate, coaxial, interdigital, or surface mount capacitors in parallel and/or series, and is integrated as part of the lamp housing. The input of the wave-launcher is connected to the output of the RF source and the output of the wave-launcher is connected to the conductive sleeve.

One or more benefits may be achieved using this novel wave-launcher electrodeless HID lamp and related methods. As an example, the novel electrodeless HID is compact and efficient and can be integrated with fixtures with substantially smaller heat sinks compared to other electrodeless HIDs including the ones with dielectric resonator/wave guide and air resonators. Furthermore, the wave-launcher electrodeless HID is simpler and is manufactured at low cost. These and other benefits may be achieved in one or more embodiments. Further details of the present invention can be found throughout the present specification and more particularly below.

Detailed Descriptions of the Embodiments are Presented:

FIG. 1 is a drawing of one embodiment of this invention. A lamp housing 200 consists of the lamp exterior 180, made from an electrically conductive material such as aluminum or conductively-coated material, and has an aperture region 195 and a bottom plate 190. The lamp exterior housing receives the vessel assembly 140 through a hole 191 in the bottom plate 190. The vessel assembly 140 consists of several sections including a top portion 141 and bottom portion 143 made from an electrically conductive material, such as aluminum, and a middle portion 142 made from an electrically non-conductive material such as a dielectric or ceramic (such as alumina). The top portion 141 of the vessel assembly has a hole at the top to receive the bulb-like vessel 170 which is attached to it using a high temperature epoxy or slurry. The plasma arc in the bulb 165 is substantially visible and it is not surrounded by the vessel assembly or the lamp exterior housing. The bottom portion of the vessel assembly 143 has a section with screw threads 145 that can be used to screw the vessel assembly into the lamp exterior housing. The vessel assembly is designed such that vessel is electrically isolated from the lamp exterior housing which is at ground potential. The vessel can be made from quartz or from a transparent/translucent dielectric material. It can filled with an inert gas such as argon or xenon and a combination of one or more metals and metal halides such as mercury, sodium, dysprosium, sulfur, indium bromide, scandium bromide, thallium iodide, holmium bromide, cesium iodide, or other similar materials. The RF source (usually enclosed in an RF driver) consists of an RF oscillator 105 and an RF amplifier 110 with supporting electronics (not shown). The wave-launcher module 115 accepts electromagnetic energy from the RF amplifier and transfers it through a wire or cable 120 and is connected to the internal conductive member 150. The conductive portion 150 is electrically isolated from the lamp housing 195 by a non-conductive platform 155. The gap 175 between the internal conductive member and the lamp exterior housing provides the voltage potential difference required to transfer electromagnetic energy that causes ionization of the gas in the vessel 170 resulting in melting and vaporizing of the metal halides and emission of intense infrared, visible, and UV light. There is also a small gap 160 to separate the internal conductive member from the vessel assembly to prevent mechanical interference when removing and replacing the vessel assembly. The operating frequency of the lamp module is substantially independent of the dimensions of the lamp exterior housing and instead is primarily determined by the values of the components used in the wave-launcher module. The lamp exterior housing can be any shape including rectangular, circular, hexagonal, etc. without significantly impacting the operation of the lamp.

Figure 2:
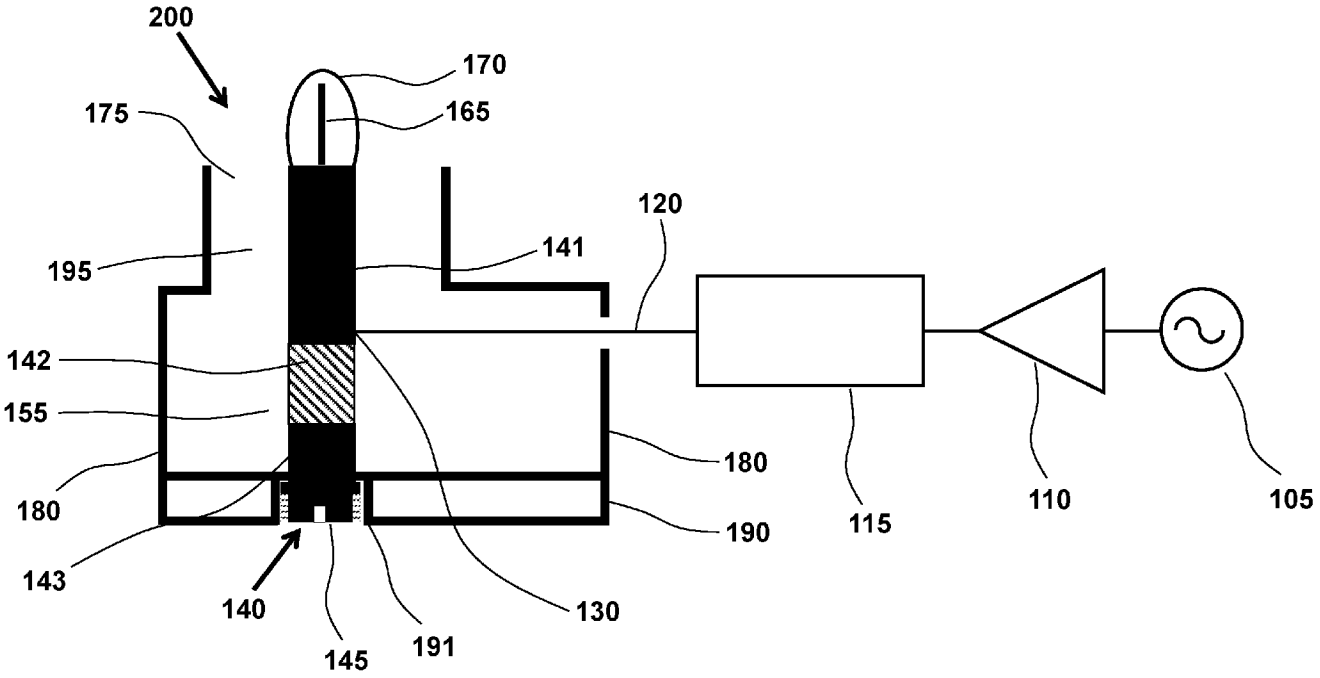
FIG. 2 is a drawing of another embodiment of this invention in which the wave-launcher module is connected directly to the vessel assembly.

FIG. 2 is a drawing of another embodiment of this invention. This embodiment is similar to the embodiment shown in FIG. 1 except that the internal conductive member and the non-conductive platform in the lamp exterior housing 200 have been removed and the wave-launcher module 115 is connected via a conductive wire or cable 120 directly via connection 130 to the top portion 141 of the vessel assembly 140. Similar to the embodiment in FIG. 1 the top portion of the vessel assembly is electrically isolated from the lamp body 180 using an electrical insulator 155.

Figure 3:
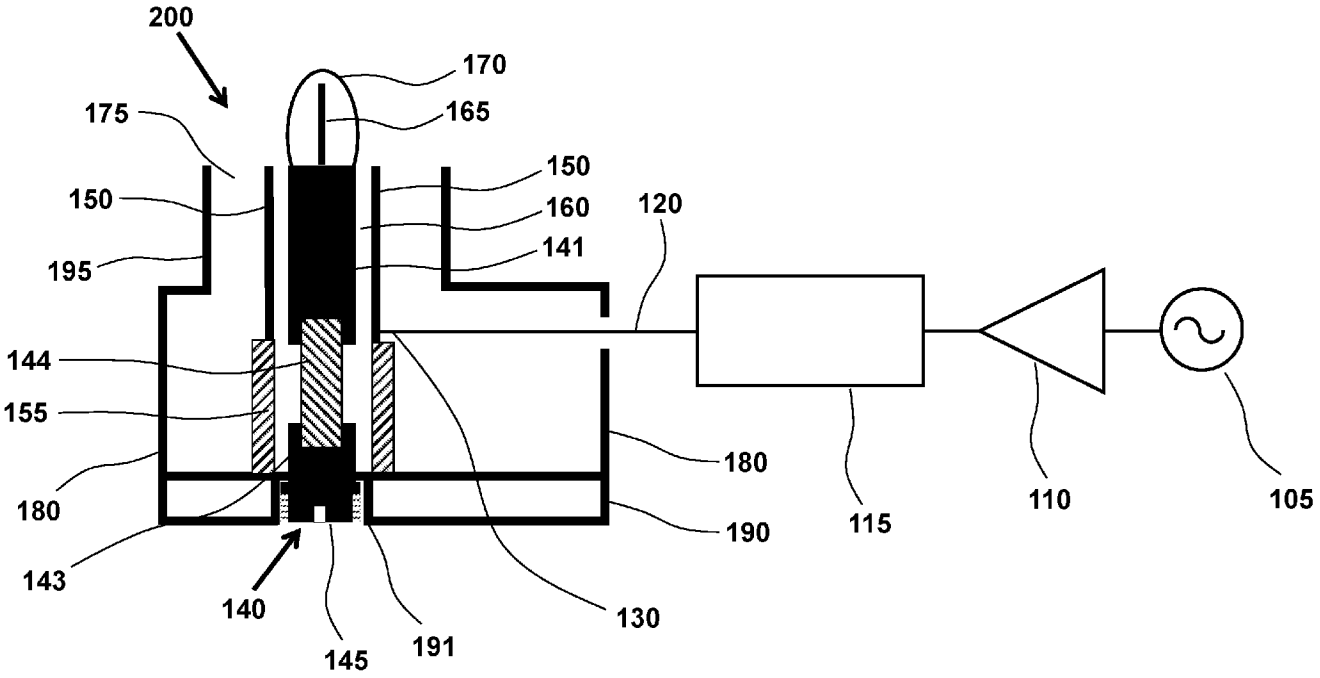
FIG. 3 is a drawing of another embodiment of this invention showing an electrodeless lamp similar to FIG. 1 with a different embodiment of the vessel assembly.

FIG. 3 is a drawing of another embodiment of this invention. This embodiment is similar to the drawing in FIG. 1 except the vessel assembly 140 is different. The vessel assembly still consists of two electrically conductive sections 141 and 143 made from a material such as aluminum. A dielectric rod 144 made from a material such as alumina is partially inserted into to the top and bottom portion of the vessel assembly. The dielectric rod provides mechanical connection between the two sections while electrically isolating them. In addition, the dielectric rod allows thermal heat flow from the bulb into the bottom section of the vessel assembly and through the threaded screw contact 145 into the lamp exterior housing.

Figure 4:
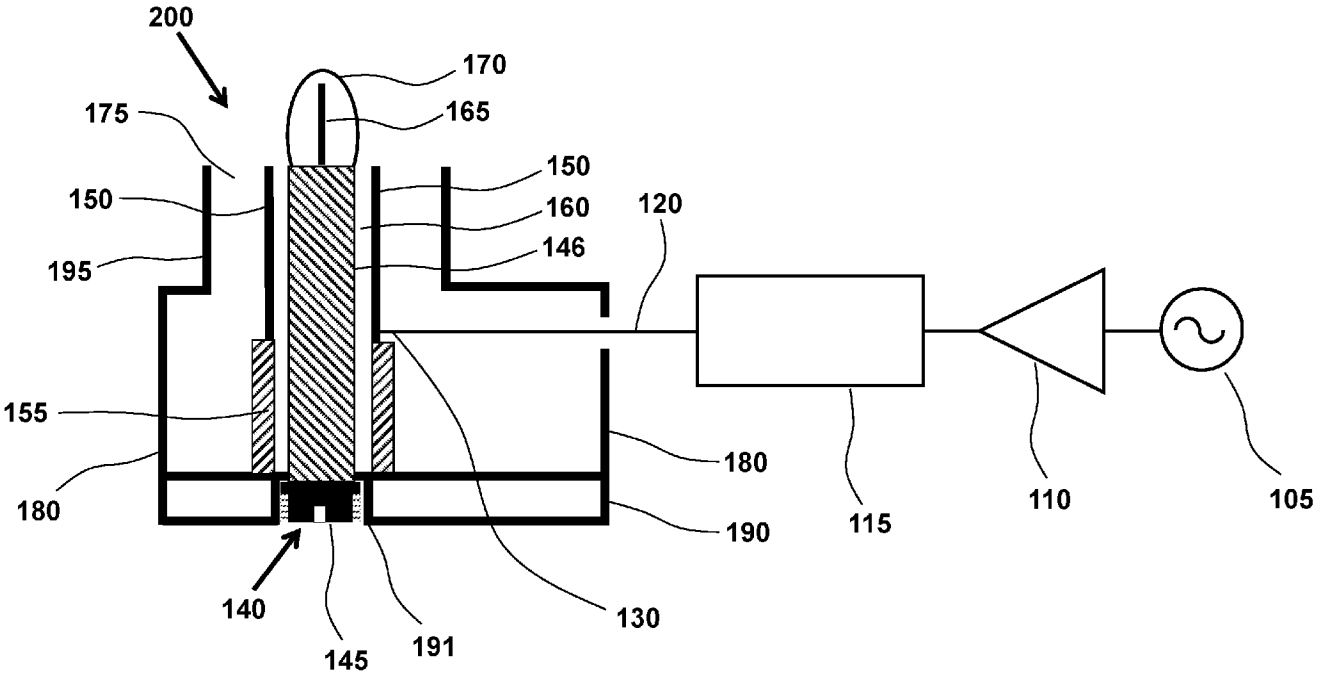
FIG. 4 is a drawing of another embodiment of this invention showing an electrodeless lamp similar to FIG. 1 but with a vessel assembly with a support structure that is primarily made from dielectric/ceramic material.

FIG. 4 is a drawing of another embodiment of this invention. This embodiment is similar to the drawing in FIG. 1 except the bulb assembly 140 is different. The vessel assembly consists of a dielectric rod 146 made from a material such as alumina. At one end of the rod, the rod has a hole in it for inserting and attaching the vessel to it using a high temperature epoxy or slurry. The other end of the rod is attached to a metallic screw 145 that can be used to screw in the vessel assembly into the lamp body. The use of the dielectric rod electrically isolates the bulb from the lamp exterior housing while allowing the heat generated while the bulb is operating to be transferred to the lamp body via the dielectric rod.

Figure 5:
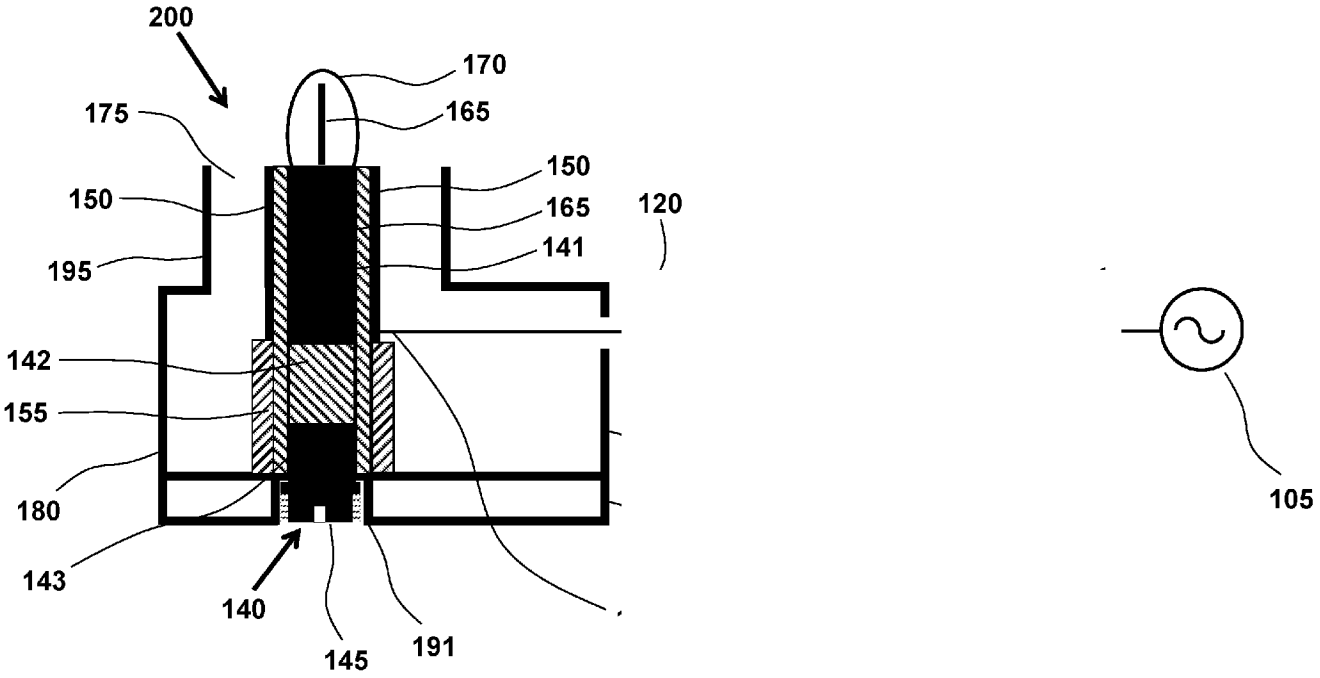
FIG. 5 is a drawing of another embodiment of this invention showing an electrodeless lamp similar to FIG. 1 but with a layer of dielectric material between the vessel assembly and an internal electrically-isolated conductive member within the lamp housing.

FIG. 5 is a drawing of another embodiment of this invention showing an electrodeless lamp similar to FIG. 1 but with a layer of dielectric material 165 replacing the air gap 160 of FIG. 1 between the vessel assembly 140 and the internal conductive member 150. The dielectric material 165 can also be the surface anodization of 141 and 150 if they are made with a material whose surface can be oxidized such as aluminum.

Figure 6:
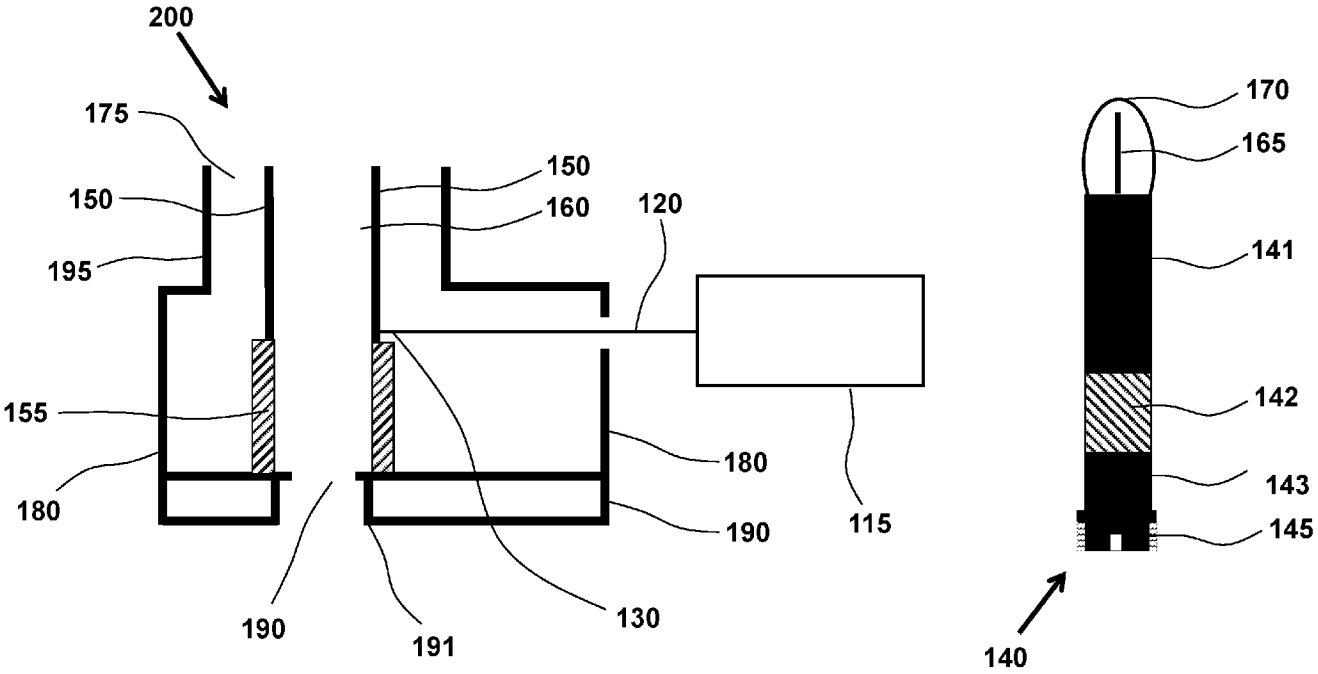
FIG. 6 is a drawing of the embodiment show in FIG. 1 but with vessel assembly separated from the lamp housing showing the ability to replace the vessel assembly from the lamp housing.

FIG. 6 is another drawing of the embodiment shown in FIG. 1. In this Figure the vessel assembly 140 has been removed from the lamp exterior housing 200. This shows the ability to replace the vessel in the lamp module once the bulb has aged and its light output has dropped below a certain level.

Figure 7:
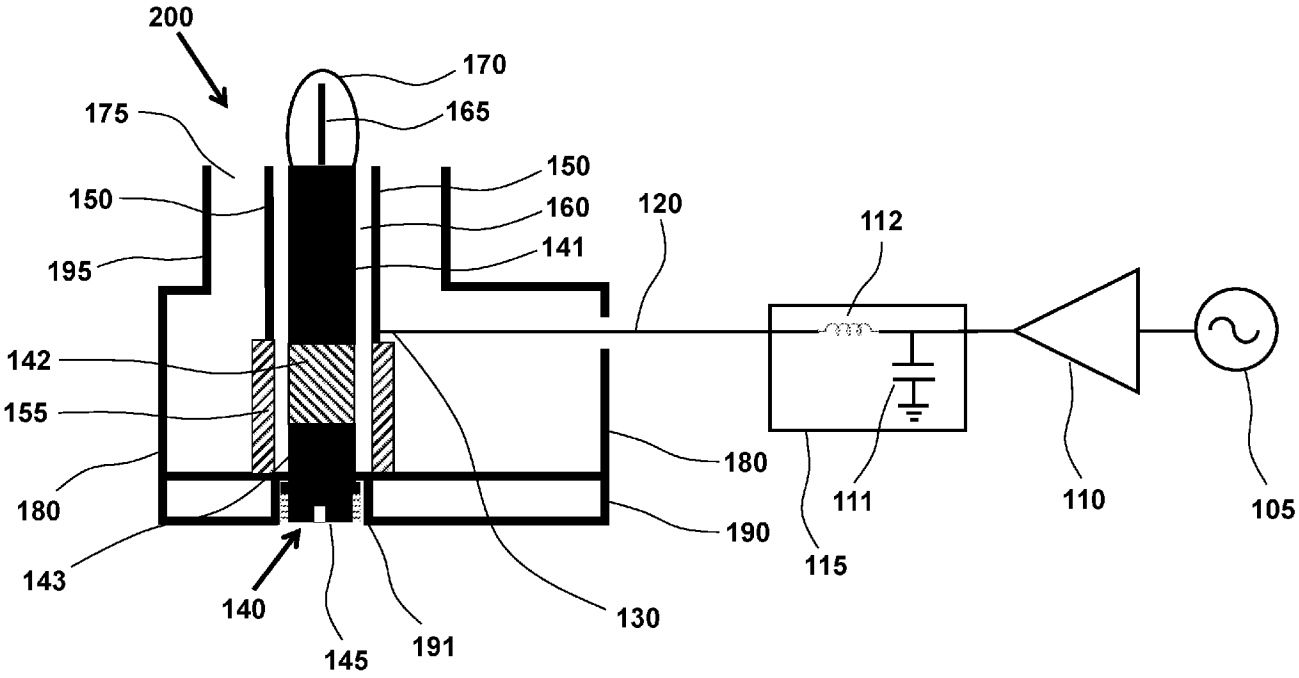
FIG. 7 is a drawing of an embodiment of this invention in which an inductor and capacitor are used as part of the wave-launcher to transmit RF energy to the internal conductive member and the vessel.

FIG. 7 is a drawing of another embodiment of this invention similar to the embodiment shown in FIG. 1. In this embodiment an example of the components in the wave-launcher module 115 are shown consisting of a capacitor 111 and an inductor 112. While just once capacitor and one inductor are shown the wave-launcher can consist of several capacitors and several inductors. The value of these components is selected to set the desired frequency of operation of the lamp module 200 and maximize the transfer of RF energy from the RF source 105 and 110 to the vessel 170.

Figure 8:
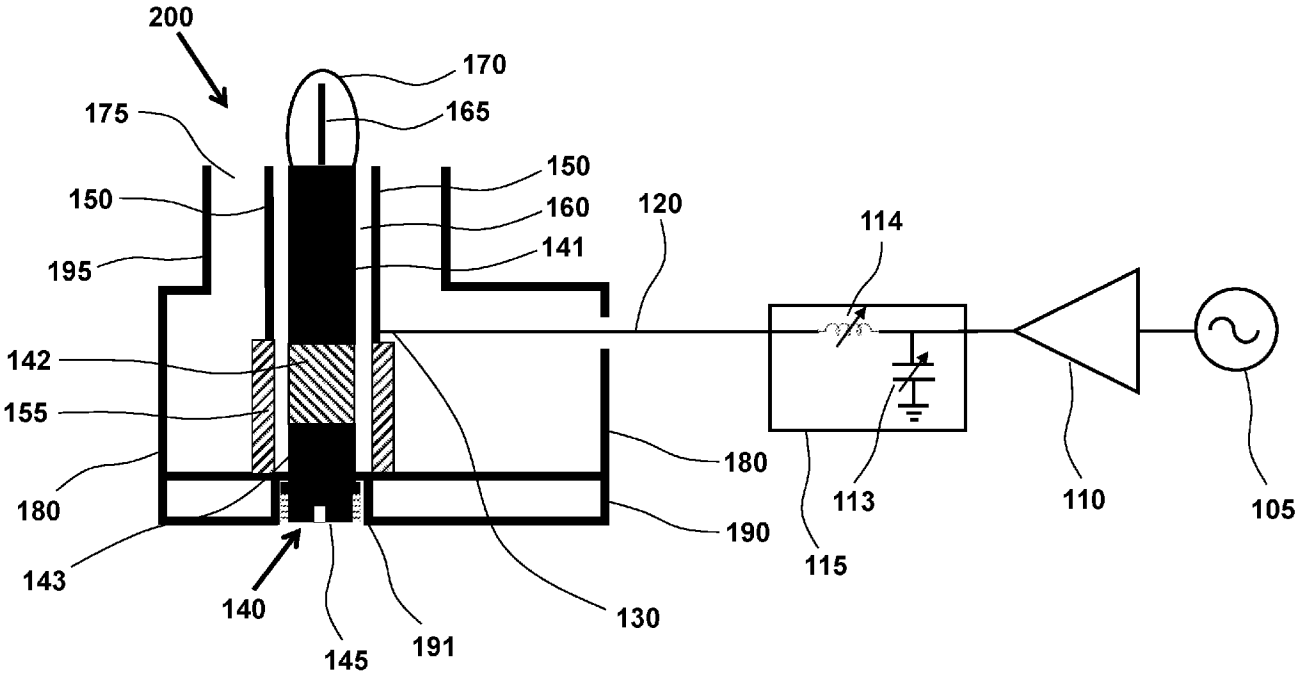
FIG. 8 is a drawing of another embodiment of this invention in which a variable inductor and a variable capacitor are used as part of the wave-launcher module to transmit RF energy to the internal conductive member and the vessel.

FIG. 8 is a drawing of another embodiment of this invention. This embodiment is similar to the embodiment shown in FIG. 7 except that instead of fixed capacitors and fixed inductors as part of the wave-launcher module 115, variable capacitor 113 and variable inductor 114 are used. It is also possible to use a combination of both fixed and variable capacitors and inductors. The use of variable capacitors and inductors adds flexibility during the manufacturing of the lamp module by allowing the ability for the operator to tune the wave-launcher to set the desired operating frequency of the lamp module 200 and optimize transfer of the RF energy from the RF source 105 and 110 to the vessel 170.

Figure 9:
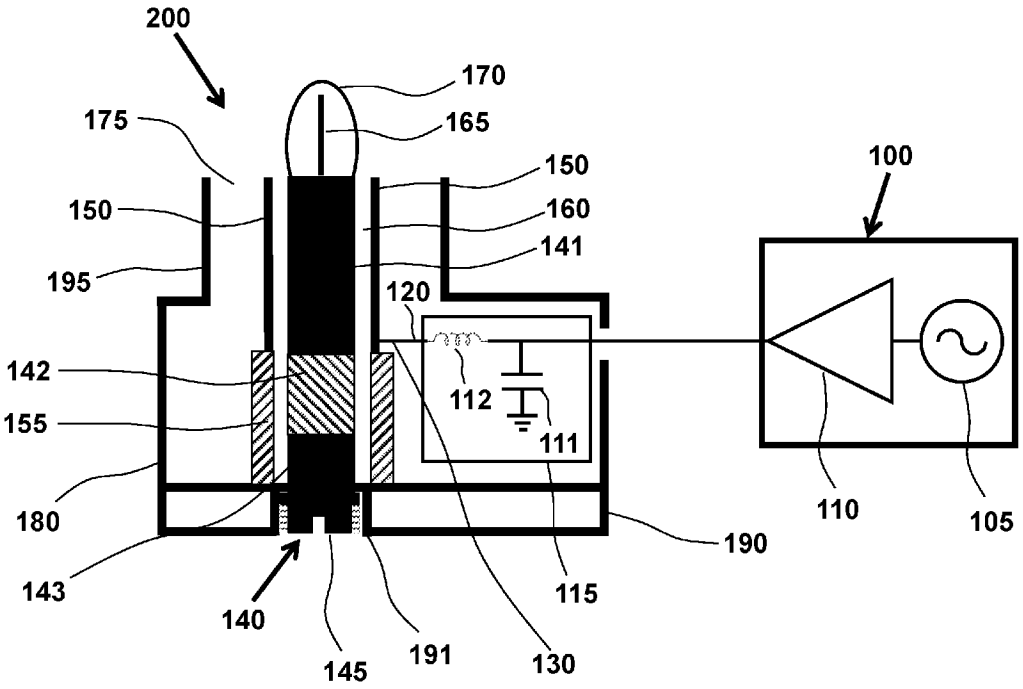
FIG. 9 is a drawing of another embodiment of this invention in which the inductor and capacitor shown in FIG. 7 as part of the wave-launcher are integrated within the lamp housing.

FIG. 9 is a drawing of another embodiment of this invention. It is similar to the embodiment in FIG. 7 except that wave-launcher module 115 is integrated within the body 180 of the lamp exterior housing 200. In this embodiment, the RF source and RF amplifiers represented together within an RF driver 100.

Figure 10:
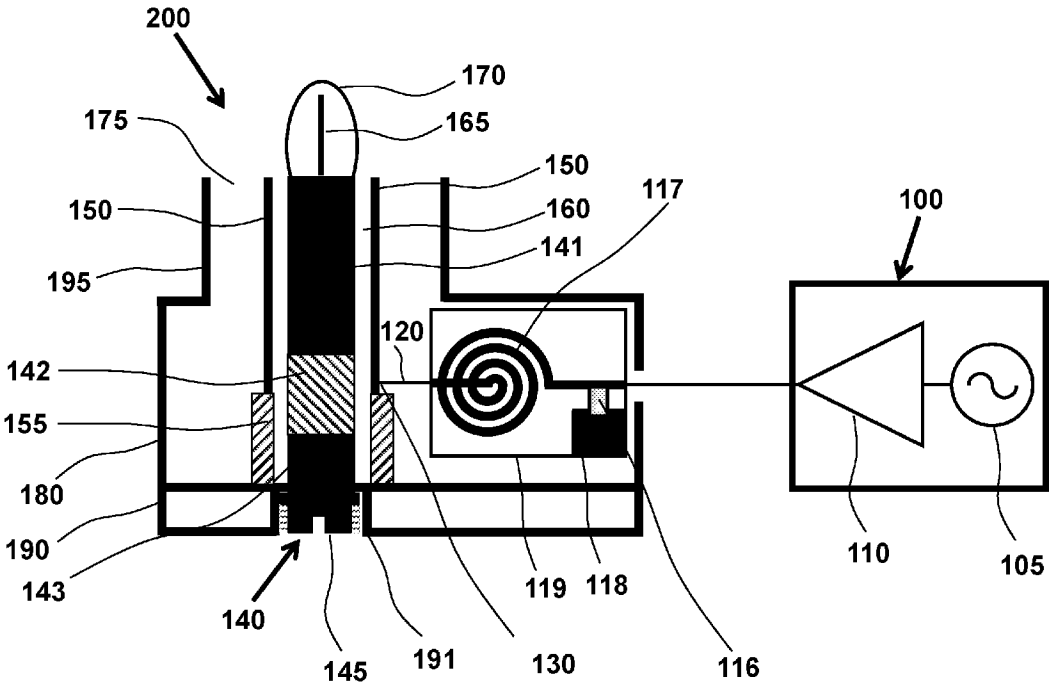
FIG. 10 is a drawing of another embodiment of this invention in which for the inductor of the wave-launcher shown in FIG. 9 a printed circuit board (PCB) spiral inductor line and for the capacitor a surface mount chip capacitor are used.

FIG. 10 is a drawing of another embodiment of this invention. It is similar to the embodiment in FIG. 9 except that the wave-launcher module 119 consists of a printed circuit board (PCB) with a spiral inductor 117 in series and a surface mount capacitor 116 connected between the signal line and ground 118. The wave-launcher is integrated within the lamp exterior housing 200. The output of the wave-launcher module 120 is connected 130 to the conductive portion 150. Again, in this embodiment, the RF source and RF amplifier is represented together within an RF driver 100.

Figure 11:
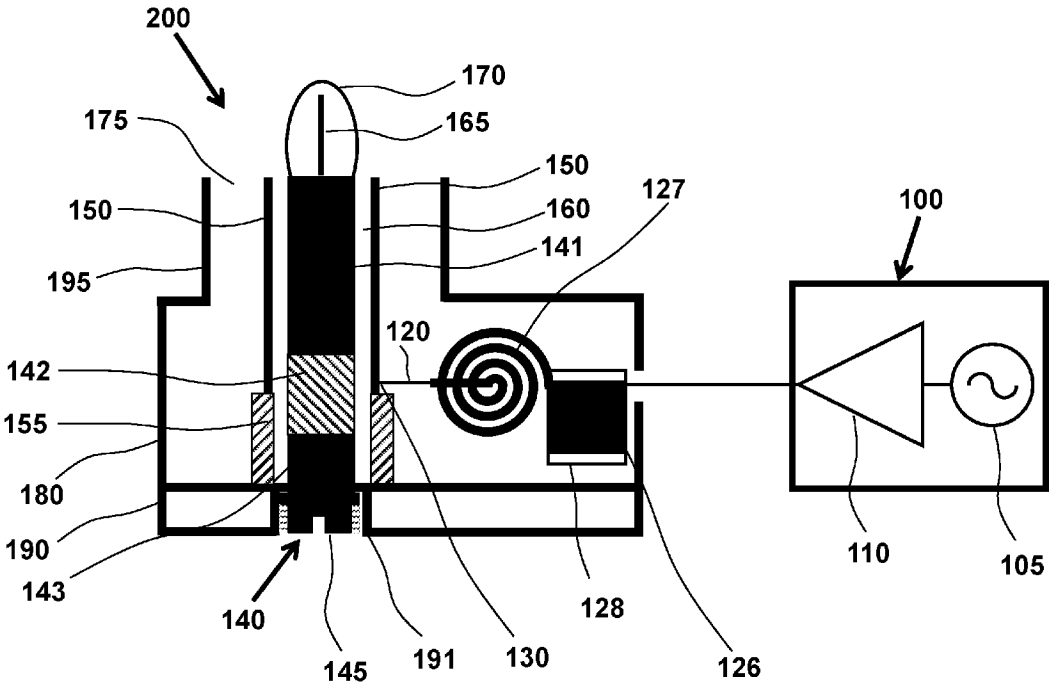
FIG. 11 is a drawing of another embodiment of this invention in which for the inductor of the wave-launcher shown in FIG. 9 a solid metallic spiral inductor and for the capacitor a parallel plate capacitor are used.

FIG. 11 is a drawing of another embodiment of this invention. It is similar to the embodiment in FIG. 9 except that the wave-launcher module 119 consists of one or more solid metallic or conductively-coated spiral (or helical) spiral inductors 127 in series and separate one or more parallel plate, coaxial, interdigital, or surface mount capacitors 126 connected between the signal line and ground 128. The wave-launcher is integrated within the lamp exterior housing 200. The output of the wave-launcher 120 is connected 130 to the internal conductive member 150. Again, in this embodiment, the RF source 105 and RF amplifier 110 is represented together within an RF driver 100.

Figure 12:
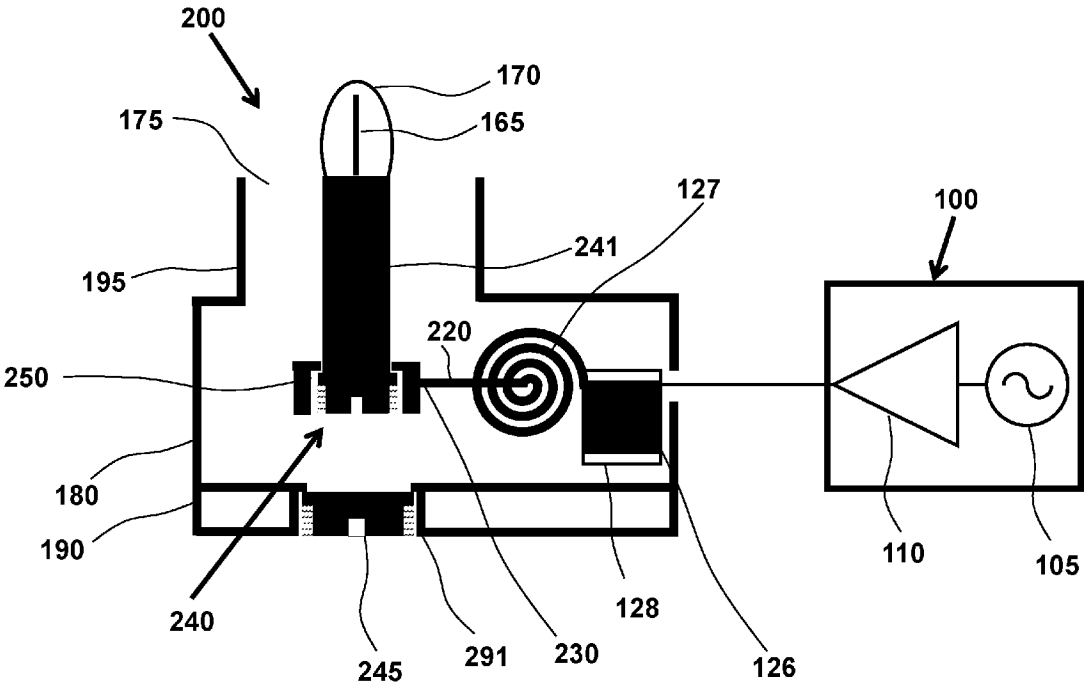
FIG. 12 is a drawing of another embodiment of this invention in which the vessel assembly consists of a vessel that is attached to an internal conductive member which is isolated from the lamp housing.

FIG. 12 is a drawing of another embodiment of this invention. It is similar to the embodiment in FIG. 11 except the vessel assembly 240 consist of a vessel 170 that is attached to one end of an electrically conductive section 241 made from a material such as aluminum. The other end of the conductive section 241 has screw threads such that it can be screwed into an electrically conductive ring 250 also made from a material such as aluminum. The spiral inductor 127 is connected via conductor 220 to the conductive ring 250 via connection 230. The vessel assembly and conductive ring are structurally supported by their connection to the spiral inductor and are electrically isolated from any direct connection to the lamp body 180. The bottom plate 190 of the lamp module 200 has an access hole 291 that is used to change the vessel assembly. The hole 291 is plugged with the screw-in plug 245 during normal lamp operation.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. An electrodeless high intensity discharge lamp comprising:

a housing comprising spatial volume surrounded by an exterior region;

an aperture region formed on a portion of the exterior region to expose the spatial volume;

an interior wall comprising a conductive material formed within the aperture region and coupled to the aperture region;

an upper surface region configured overlying the interior wall region to form a border of the aperture region;

a conductive internal housing member shaped as a cylindrical sleeve member, and having a first end and a second end and a length defined between the first end and the second end, the cylindrical sleeve member configured to be normal to a direction of the upper surface region, and in parallel to a direction of the interior wall such that the first end of the cylindrical sleeve is inserted intimately within the interior wall region to extend from the spatial volume to a plane region parallel to the surface region and such that the conductive internal housing member is electrically isolated from the interior wall of the housing;

a spatial gap region formed between the interior wall and an external region of the conductive internal housing member to form the electrical isolation between the interior wall of the housing and the conductive internal housing member;

a constant width characterizing an annular region included in the spatial gap region, the annular region having an outer circumference and an inner circumference having a spacing defined by the constant width from a zero point to the zero point through a 360 degree rotation;

a vessel made from a light transmitting material, the vessel comprising any combination of a gas, a solid, and a liquid contained within an interior volume of the vessel, the vessel comprising a mechanical support region, and the mechanical support region positioning the vessel within a center portion of the aperture region;

a wave-launcher module comprising an RF input for inputting a first RF signal having a first frequency range and a first voltage range, and an RF output for a second RF signal having the first frequency range and a second voltage range, and configured to output the second RF signal to the spatial gap region using the conductive internal housing to cause electromagnetic radiation to be emitted from the vessel.

2. The lamp of claim 1 further comprising:

an RF driver coupled to the RF input of the wave-launcher module such that electromagnetic energy is transferred from the RF driver to the vessel;

wherein the vessel further comprises a plurality of metals, metal halides, and inert gases that are capable of discharging light when illuminated with electromagnetic fields;

wherein the housing is made entirely or partially of a metal, similar conductive material, or material that is conductively coated.

3. The lamp of claim 1 wherein the housing comprises a plurality of aperture regions.

4. The lamp of claim 1 wherein the vessel is mounted on a post member and placed within the cylindrical sleeve member such that the vessel protrudes from one of the aperture.

5. The lamp of claim 1 wherein the vessel is positioned partially within the interior wall and outside of the upper surface region.

6. The lamp of claim 1 wherein the vessel is mounted on a post member such that the post member and vessel are removable together as a single assembly from the housing.

7. The lamp of claim 1 wherein the vessel is mounted on a post member, the post member comprising a material selected from a conductive or non-conductive material, and electrically isolated from the housing.

8. The lamp of claim 1 wherein the cylindrical sleeve member is comprising a separate conductive portion that is electrically isolated from the housing, and configured overlying a non-conductive platform to structurally mount the sleeve within the spatial volume of the housing.

9. The lamp of claim 1 wherein the conductive internal housing member is shaped as the cylindrical sleeve member or other shapes, including a conical member, a rectangular member, an octagonal member, a hexagonal member, or other regular or irregular shapes or combinations thereof.

10. The lamp of claim 1 wherein the wave-launcher module is configured within the housing or outside of the housing and wherein the wave-launcher module is electrically coupled between the RF driver and the conductive internal housing member coupled to the vessel.

11. An electrodeless high intensity discharge lamp comprising:

a housing comprising spatial volume surrounded by an exterior region;

an aperture region formed on a portion of the exterior region to expose the spatial volume;

an interior wall comprising a conductive material formed within the aperture region and coupled to the aperture region;

an upper surface region configured overlying the interior wall region to form a border of the aperture region;

a conductive internal housing member shaped as a cylindrical sleeve member, and having a first end and a second end and a length defined between the first end and the second end, the cylindrical sleeve member configured to be normal to a direction of the upper surface region, and in parallel to a direction of the interior wall such that the first end of the cylindrical sleeve is inserted intimately within the interior wall region to extend from the spatial volume to a plane region parallel to the surface region and such that the conductive internal housing member is electrically isolated from the interior wall of the housing;

a spatial gap region formed between the interior wall and an external region of the conductive internal housing member to form the electrical isolation between the interior wall of the housing and the conductive internal housing member;

a constant width characterizing an annular region included in the spatial gap region, the annular region having an outer circumference and an inner circumference having a spacing defined by the constant width from a zero point to the zero point through a 360 Degree rotation;

a vessel made from a light transmitting material, the vessel comprising any combination of a gas, a solid, and a liquid contained within an interior volume of the vessel, the vessel comprising a mechanical support region, and the mechanical support region positioning the vessel within a center portion of the aperture region;

a wave-launcher module comprising an RF input for inputting a first RF signal having a first frequency range and a first voltage range, and an RF output for a second RF signal having the first frequency range and a second voltage range, and configured to output the second RF signal to the spatial gap region using the conductive internal housing to cause electromagnetic radiation to be emitted from the vessel; and an electrical circuit having a capacitive characteristic and an inductive characteristic included in the wave-launcher module.

12. The lamp of claim 11 wherein the wave-launcher module comprises a fixed inductor, a fixed capacitor, a variable inductor, or a variable capacitor or any combinations thereof is included in the wave-launcher module; wherein the wave-launcher module comprises a printed circuit board (PCB).

13. The lamp of claim 11 wherein the wave-launcher module comprises an LC transformer.

14. The lamp of claim 11 wherein the wave-launcher module comprises a spiral inductor and a plurality of capacitors; or wherein the wave-launcher module comprises a planar spiral inductor and a plurality of surface mount capacitors.

15. The lamp of claim 11 wherein the wave-launcher module comprises a plurality of distributive elements.

16. The lamp of claim 11 wherein the wave-launcher module comprises a solid metallic or conductively-coated spiral, helical, or similarly configured inductive line in combination with a parallel-plate, coaxial, interdigital, or surface mount capacitors.

17. The lamp of claim 11 wherein the wave-launcher module comprises an inductive transformer and a combination of parallel-plate, coaxial, interdigital, or surface mount capacitors.

18. The lamp of claim 11 wherein the wave-launcher module comprises a mutual inductive structure consisting of conductive rods, lines, plates, helical coils, spirals, or similar structures along with a combination of parallel-plate, coaxial, interdigital, or surface mount capacitors.

19. The lamp of claim 11 wherein the wave-launcher module is comprised of a combination of surface mount, solid, PCB line, transformer-like, or mutual inductive structures and a combination of parallel-plate, coaxial, interdigital, or surface mount capacitors.

20. An electrodeless high intensity discharge lamp comprising:

a housing comprising spatial volume surrounded by an exterior region;

an aperture region formed on a portion of the exterior region to expose the spatial volume;

an interior wall comprising a conductive material formed within the aperture region and coupled to the aperture region;

an upper surface region configured overlying the interior wall region to form a border of the aperture region;

a vessel made from a light transmitting material, the vessel comprising any combination of a gas, a solid, and a liquid contained within an interior volume of the vessel, the vessel comprising a mechanical support region, and the mechanical support region positioning the vessel within a center portion of the aperture region;

a post member comprising a conductive region and having a first end and a second end, the first end being coupled to the vessel;

a spatial gap region formed between the interior wall and an external region of the post member to form the electrical isolation between the interior wall of the housing and the post member;

a constant width characterizing an annular region included in the spatial gap region, the annular region having an outer circumference and an inner circumference having a spacing defined by the constant width from a zero point to the zero point through a 360 Degree rotation;

a wave-launcher module comprising an RF input for inputting a first RF signal having a first frequency range and a first voltage range, and an RF output for a second RF signal having the first frequency range and a second voltage range, and configured to output the second RF signal to the spatial gap region using the post member to cause electromagnetic radiation to be emitted from the vessel.

* * * * *